US007225721B2

(12) United States Patent
Lemaire

(10) Patent No.: US 7,225,721 B2
(45) Date of Patent: Jun. 5, 2007

(54) HYDRAULIC MOTOR

(75) Inventor: Gilles Lemaire, Margny les Compiegnes (FR)

(73) Assignee: Poclain Hydraulics Industrie, Verberie (FR)

( * ) Notice: Subject to any disclaimer, the term of this patent is extended or adjusted under 35 U.S.C. 154(b) by 0 days.

(21) Appl. No.: 11/156,815

(22) Filed: Jun. 20, 2005

(65) Prior Publication Data

US 2005/0287015 A1 Dec. 29, 2005

(30) Foreign Application Priority Data

Jun. 28, 2004 (FR) ..... 04 07038

(51) Int. Cl.
*F01B 1/06* (2006.01)
*F01B 13/06* (2006.01)

(52) U.S. Cl. ..... 92/72; 91/491

(58) Field of Classification Search ..... 91/491, 91/498; 92/72; 417/273
See application file for complete search history.

(56) References Cited

U.S. PATENT DOCUMENTS 3,046,950 A * 7/1962 Smith ..... 91/498
3,267,861 A * 8/1966 Pigeroulet et al. ..... 91/491
4,144,000 A * 3/1979 Hollett et al. ..... 417/462
4,643,077 A 2/1987 Bock
5,606,938 A * 3/1997 Rowe ..... 123/54.3
5,979,295 A * 11/1999 Larker et al. ..... 92/72
6,575,078 B1 6/2003 Wright et al.

FOREIGN PATENT DOCUMENTS

FR 2834012 6/2003

* cited by examiner

*Primary Examiner*—Thomas E. Lazo
(74) *Attorney, Agent, or Firm*—Ladas & Parry LLP

(57) ABSTRACT

The motor comprises a cam and a cylinder block mounted to rotate one relative to the other. The cam comprises a plurality of cam lobes and the cylinder block has a plurality of cylinders slidably receiving pistons that are suitable for co-operating with the cam. The motor further comprises a fluid distributor that includes distribution ducts suitable for being connected to a feed or to a discharge and disposed in register with the rising ramp and with the falling ramp of the cam lobes. The motor is a substantially constant-velocity motor. In any relative position of the cylinder block and of the cam, there is at least one cam lobe that is unused and with which no piston co-operates, and the angular spacings between consecutive cylinders are mutually different and differ from a multiple of the smallest angular spacing between consecutive cylinders, the angular spacings being determined so that the resultant of the forces exerted by the pistons on the cam is small or substantially zero.

13 Claims, 6 Drawing Sheets

HYDRAULIC MOTOR

FIELD OF THE INVENTION

The present invention relates to a hydraulic motor comprising a cam and a cylinder block that are suitable for rotating one relative to the other about an axis of rotation, the cam comprising a plurality of cam lobes each of which has a rising ramp M and a falling ramp D, and the cylinder block having a plurality of cylinders slidably receiving pistons that are suitable for co-operating with the cam, the motor further comprising a fluid distributor that is constrained to rotate with the cam about the axis of rotation and that includes distribution ducts connected via distribution orifices to a feed or to a discharge and suitable for communicating with the cylinders while the cylinder block and the cam are rotating relative to each other, each distribution orifice being disposed in register with a ramp of a cam lobe such that a cylinder whose piston is co-operating with a rising ramp can be connected to the feed and such that a cylinder whose piston is co-operating with a falling ramp can be connected to the discharge, the instantaneous angular positions in which the pistons co-operate with the cam while the cylinder block and the cam are rotating relative to each other being such that the motor is a substantially constant-velocity motor.

BACKGROUND OF THE INVENTION

A hydraulic motor of that type is known from the prior art. An example is a hydraulic motor having radial pistons and of the type described in French Patent No. 2 834 012.

The motor is a substantially constant-velocity motor, which means that, when the fluid feed flow rate is constant, the speed of rotation of the rotary portion of the motor (cylinder block or cam) is substantially constant. In other words, the rotation takes place smoothly, i.e. without any jolts. In a constant-velocity motor, the fluid budget should be substantially zero, i.e. at any time, the quantity of fluid entering the cylinders must be substantially equal to the quantity of fluid leaving them.

In motors of that type, it is generally desired to distribute the cylinders uniformly in the cylinder block. In other words, the angular spacing between the cylinders of each pair of consecutive cylinders is constant. Such uniform distribution is, in particular, related to the concern to ensure that the center of symmetry of the cylinder block is situated substantially on its geometrical axis, which is also its axis of rotation. In addition, in general, when designing a motor, it is desired for the motor to be compact which, for the cylinder block, leads in particular to minimizing the spacing between two consecutive cylinders while accommodating cylinders of a size suitable for obtaining the desired cubic capacity.

Starting from a basic motor design, it is possible to seek to form a motor that is slightly different, in particular a motor that has a reduced cubic capacity. In this approach, for reasons of cost-saving and of rationalization, the designer seeks, as far as possible, for the slightly different motor to use parts that have already been defined for the basic motor.

The cubic capacity of a motor depends on the size of its cylinders and on the maximum possible stroke of the pistons disposed in the cylinders. The stroke itself depends on the amplitude of the undulations of the cam, i.e. on the depth of the cam lobes. Thus, starting from an existing motor, it is possible to define a motor of reduced cubic capacity by replacing the cam of the pre-existing motor with cam lobes of depth that is reduced relative to the depth of the cam lobes of the pre-existing cam. However, that technique has its limitations. It results in decreasing the gradient of the ramps of the cam lobes, which is possible only up to a certain point, while also preserving the essential qualities of the motor. In general, it is thus considered that it is inappropriate to reduce the stroke of the pistons by more than 50%.

It should be added that it is not always desirable, when designing a hydraulic motor that has a cubic capacity smaller than the cubic capacity of a pre-existing motor, to design a motor whose elements are smaller in size than the corresponding elements of the pre-existing motor. In particular, the specifications for braking torque, for dimensioning of the bearings that are to support the object rotated by the motor, or for the speed of said motor, can all require the presence of components that are sufficiently large. In addition, it can be advantageous for the motor of reduced cubic capacity to have overall size identical to the overall size of the pre-existing motor, in particular to make it interchangeable.

OBJECTS AND SUMMARY OF THE INVENTION

An object of the present invention is to define a motor that can be derived from a pre-existing motor of larger cubic capacity by using methods other than the above-mentioned method consisting in reducing the depth of the cam lobes, and while having a large number of parts in common with the original motor.

This object is achieved by the fact that, in any relative position of the cylinder block and of the cam, there is at least one cam lobe that is unused and with which no piston co-operates, and by the fact that the angular spacings between consecutive cylinders are mutually different and differ from a multiple of the smallest angular spacing between consecutive cylinders, said angular spacings being determined so that the resultant of the forces exerted by the pistons on the cam is small or substantially zero.

In the motor of the invention, it is by using a smaller number of cylinders while always leaving at least one cam lobe instantaneously unused, and by defining a particular distribution for said cylinders in the cylinder block that it is possible to achieve a reduced cubic capacity. In fact, the motor of the invention can differ from an original motor solely by its cylinder block, it being possible for all of the other parts, even the pistons, to be kept unchanged, even though the number of pistons is naturally smaller.

When a motor is derived from a pre-existing motor, its cost is lower than the cost of a motor of the same reduced cubic capacity but obtained by reducing the depth of the cam lobes of the pre-existing motor. This reduction in costs is due to the reduction in the number of cylinders (fewer bores to machine, and fewer pistons).

In the motor of the invention, the distribution of the cylinders in the cylinder block is no longer uniform as it is in prior art motors, and unlike in the prior art, the aim is not to dispose as many cylinders as possible in the cylinder block for a given size of cylinder block. On the contrary, the cylinders are distributed non-uniformly so that the motor is a substantially constant-velocity motor with its non-uniform distribution, and so that it is substantially balanced, i.e. so that the resultant of the forces exerted by the pistons on the cam is small or even zero.

In the motor of the invention, it is possible to obtain ratios of number-of-cylinders over number-of-cam-lobes that cannot be obtained in a constant-velocity motor in which the cylinders are distributed uniformly.

The term "small" means that said resultant is sufficiently small to avoid premature wear of certain parts of the motor (in particular the bearings) due to the need to compensate for said resultant. In other words, the life of the bearings is substantially the same for the motor having a reduced cubic capacity as for an analogous original motor having the maximum number of cylinders that can be received in its cylinder block, and spaced apart from one another. In particular, it is considered that the resultant of the forces exerted by the pistons on the cam is small if it is at the most of the same order of magnitude as the thrust force from a piston in its cylinder (lying in the range 0 times said force to 1.3 times said force).

In the context of the present patent application, the fact that a cam lobe is "unused" should be understood in the instantaneous sense: at some given instant, no piston is in contact with said cam lobe, which does not mean that said lobe does not contribute to the drive torque of the motor since, naturally, said cam lobe is in contact with a piston at some other instant, during the relative rotation of the cylinder block and of the cam.

Advantageously, in a hydraulic motor comprising Np cylinders and Nc cam lobes, the angular spacings between the Np cylinders are determined as follows:

angular positions Pi are defined for an imaginary intermediate motor comprising a cam that has Nc cam lobes and an imaginary intermediate cylinder block having a number Np of cylinders that are grouped together so that the angular spacing Ei between consecutive grouped-together cylinders is equal to (360°.Nco/Nc)/Np, and when the cylinder block and the cam of said imaginary intermediate motor are in a reference relative position, where the piston of each cylinder occupies an angular position Pi (for i in the range 1 to Np), on a respective one of the Nc cam lobes, and where the number Nco is the number of consecutive cam lobes over which the imaginary intermediate motor is a constant-velocity motor; and the Np cylinders of the hydraulic motor are distributed in the cylinder block in such a manner that, when the cylinder block and the cam are in a relative position corresponding to said reference relative position of the cylinder block and of the cam of the imaginary motor, the piston of each cylinder occupies, on a cam lobe, the same angular position Pi as in the imaginary motor, and in such a manner that the resultant of the forces exerted by the pistons on the cam lobes is smaller than the resultant of the forces in the imaginary motor.

The use of the imaginary intermediate motor makes it possible to define the positions for the pistons on the Nco cam lobes of the motor over which said motor is a constant-velocity motor. This means that a motor having only said Nco cam lobes of suitable profile and having Np cylinders that are uniformly spaced apart from one another would be a constant-velocity motor. Another manner of verifying that the motor is constant-velocity over Nco cam lobes consists in establishing that the fluid budget is zero at all instants so long as the pistons of the Nc cylinders are in contact with the Nco cam lobes.

The imaginary intermediate motor thus serves, in a given reference position, to define the positions of the pistons on Nco consecutive cam lobes for which the motor is a constant-velocity motor. In the hydraulic motor of the invention, the Np cylinders of the motor are distributed so that the pistons keep the same angular positions for co-operation with the cam lobes, but while ensuring that the resultant of the forces exerted by the pistons on the cam is small.

Advantageously, the angular spacings between consecutive cylinders are not less than an angular spacing Eo equal to 360°/Npo, where Npo is an integer number greater than Np and representing the maximum number of cylinders analogous to the cylinders of said motor that could be distributed uniformly in the cylinder block.

For example, the original motor from which the motor of the invention can be derived may be a constant-velocity motor in which the angular spacings between cylinders are equal to Eo.

Advantageously, for a motor having at least one small and one large active operating cubic capacity, the motor comprises at least one group of Nc/m cam lobes whose cam lobes are inactive when the motor is in its small cubic capacity, where m is an integer divisor of Nc and not less than 2, and is defined as follows:

an imaginary intermediate motor having the cam that has Nc cam lobes and Np cylinders analogous to those of said motor would be constant-velocity over Nco cam lobes;

the numbers Npo and Nc have an integer common divisor d; and the number m is such that Nco is equal to Nc.m/d and Np is equal to Npo.m/d.

This makes it possible to define a motor of reduced cubic capacity and that has two operating cubic capacities so that, in each cubic capacity, the motor is a constant-velocity motor and has a resultant of the forces exerted by the pistons on the cam that is small.

As the person skilled in the art knows, considering a cylinder whose piston is in contact successively with the rising ramp and with the falling ramp of a cam lobe, a cam lobe is active if said cylinder is connected alternately to the fluid feed and to the fluid discharge, providing said feed and said discharge are at different pressures. The lobe is inactive when said cylinder is connected to the same pressures.

BRIEF DESCRIPTION OF THE DRAWINGS

The invention will be well understood and its advantages will appear more clearly on reading the following description of an embodiment given by way of non-limiting example. The description refers to the accompanying drawings, in which.

MORE DETAILED DESCRIPTION

Figure 1:
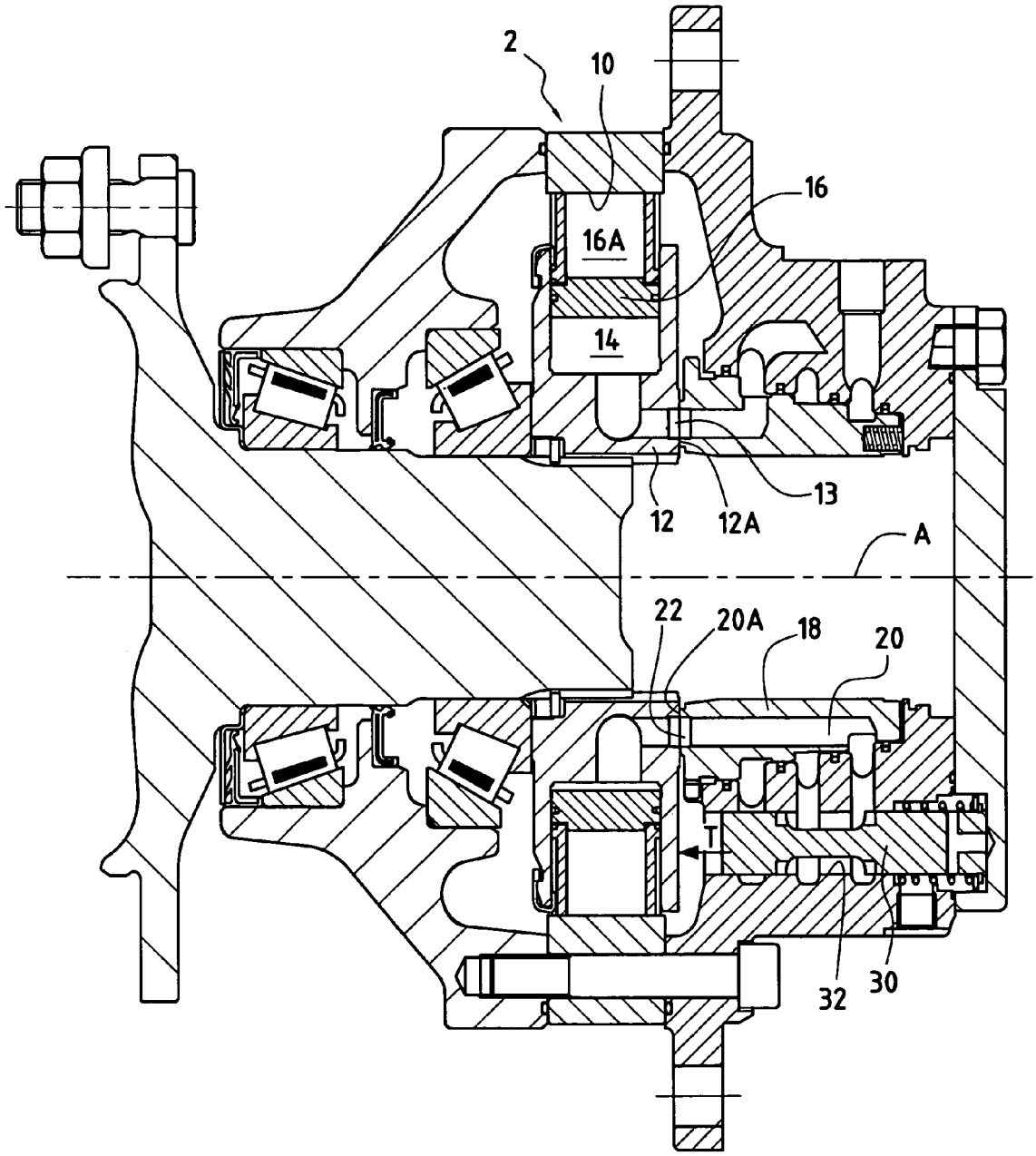
FIG. 1 is an axial section view of a motor of the same type as the motor of the invention.

The motor shown in FIG. 1 is a motor having a stationary cam and a rotary cylinder block. Naturally, the invention also applies to motors having rotary cams and stationary cylinder blocks.

Figure 2:
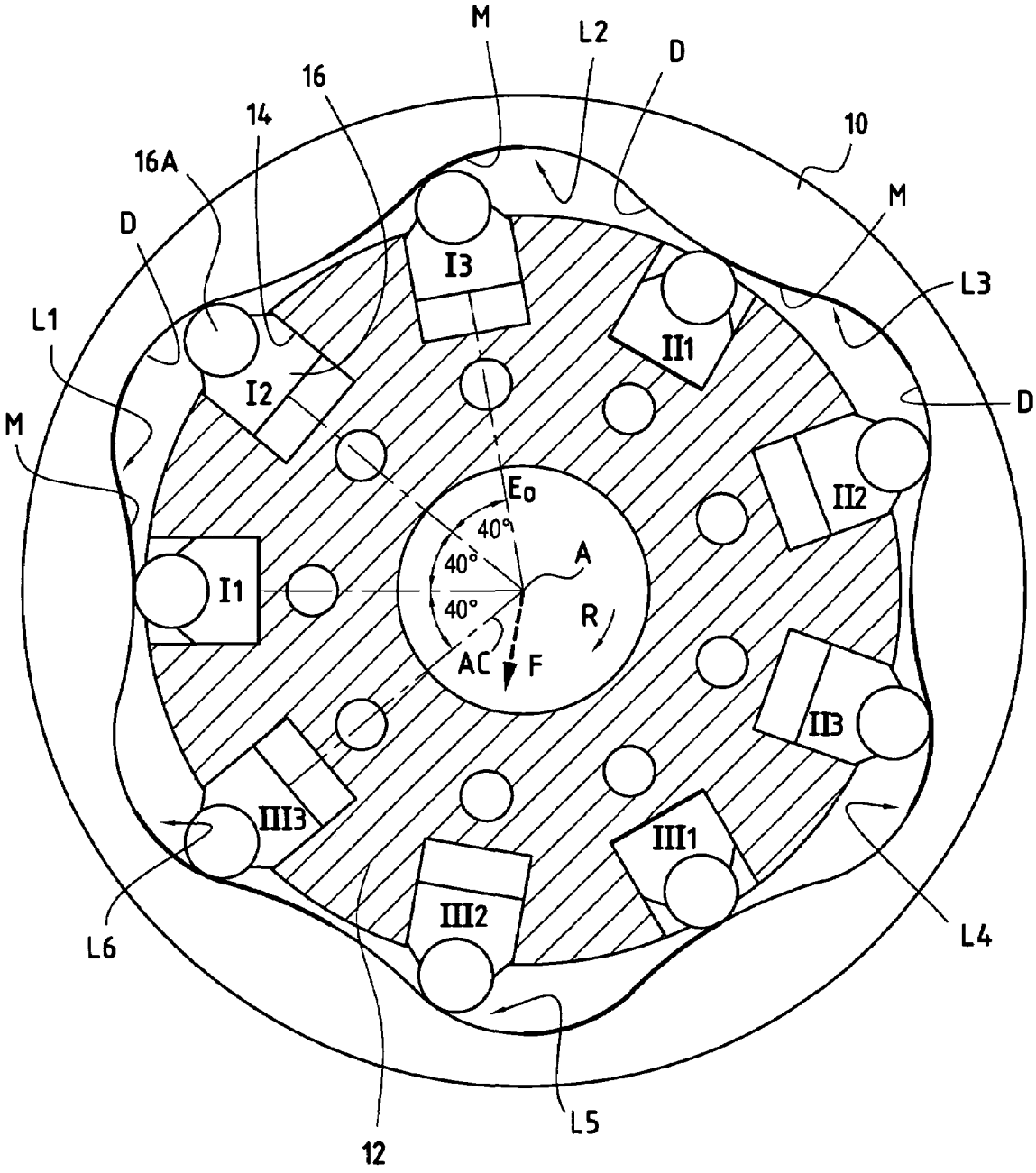
FIG. 2 is a diagrammatic radial section view of an original motor, with its cam, its cylinder block and its pistons, which motor has six cam lobes and nine pistons.

The motor of FIG. 1 comprises a casing 2 with the cam 10 forming a portion thereof, and a cylinder block 12 that is mounted to rotate relative to said cam about an axis of rotation A. The cylinder block 12 has a plurality of cylinders 14 slidably receiving pistons 16 suitable for co-operating with the cam. More precisely, at their ends remote from the axis of rotation A, the pistons 16 are provided with wheels 16A which, while the pistons are moving in their cylinders, roll on the cam. The cam comprises a plurality of cam lobes. In FIG. 2, there are six such cam lobes referenced L1 to L6. Each cam lobe has a rising ramp M and a falling ramp D. By convention, if it is considered that the cylinder block rotates relative to the cam in the direction R, the ramps of the lobes that are said to be "rising" are the ramps with which the pistons co-operate while they are moving away from the axis of rotation A.

The motor further comprises a fluid distributor 18 which is constrained to rotate with the cam about the axis A. The distributor includes distribution ducts 20 which are connected to a feed or to a discharge and which are suitable for communicating via distribution orifices 22 with the cylinders while the cylinder block and the cam are rotating relative to each other. In this example, the distribution is a plane distribution since the distribution orifices 22 are situated in a distribution face 20A of the distributor that is perpendicular to the axis of rotation A. The cylinder block has a communication face 12A in which communication orifices 13 are situated, said communication face also being perpendicular to the axis A, the distribution and the communication faces bearing against each other and the distribution and the communication orifices being disposed so that, while the cylinder block is rotating relative to the cam, the communication orifices come successively into communication with the successive distribution orifices.

In a manner known per se, e.g. from French Patent Application No. 2 834 012, each distribution orifice is disposed in register with a ramp of a cam lobe. Thus, in the direction of rotation R, and if the motor is operating at full cubic capacity, all of the distribution orifices that are situated facing rising ramps are connected to the feed while all of the distribution orifices that are situated facing falling ramps are connected to the discharge. In this example, the motor of FIG. 1 has two distinct operating cubic capacities. It has a cubic capacity selector device that is known per se (see, for example, FR 2 834 012) and that comprises a selector slide 30 disposed in a bore 32 in a casing portion and suitable, in its position shown in FIG. 1, for putting certain distribution ducts into communication with one another, in which case the motor operates at a reduced cubic capacity. When the slide 30 is moved in the direction indicated by arrow T, the distribution ducts are isolated from one another, and the motor operates at a large cubic capacity.

In FIG. 2, it can be seen that the various cylinders are spaced apart uniformly from one another. Thus, since the cylinder block of the motor of FIG. 2 comprises 9 cylinders in this example, the axes AC of said cylinders are spaced apart from each other by 40°. The axis of a cylinder is the axis of symmetry of the cylinder, extending radially from the axis rotation A.

Figure 3:
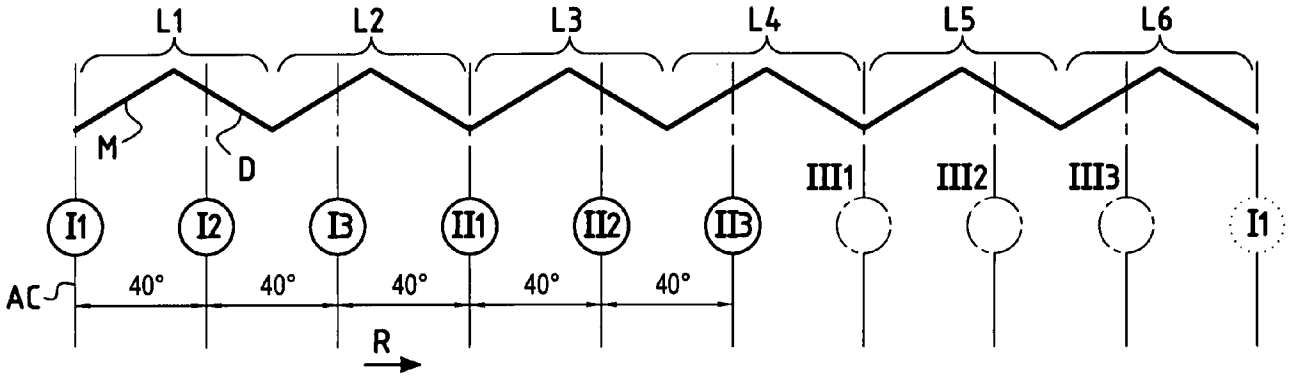
FIG. 3 is a diagrammatic developed view showing the profile of the cam lobes and the positions of the various pistons on the profile, with the cylinder block and the cam in a reference relative position.

In FIG. 3, which is a diagrammatic developed view of the cam of the motor of FIG. 2, the various cam lobes L1 to L6 are identified with their rising ramps and their falling ramps (the ramps being rectilinear in the diagrammatic view). The angular spacing Eo=40° between the cylinder axes is also indicated.

In the description below, it is considered that the angular spacing between two consecutive cylinders is the angular spacing between the cylinder axes of said two cylinders.

In FIG. 3, the cylinders are represented by their axes AC and their references are encircled.

As explained below, the cylinders and the pistons are distributed in three groups, and, in FIG. 3, the cylinders are designated by references I1 to III3, the Roman numeral that is the first portion of the reference designating the group to which the cylinder in question belongs, while the Arabic numeral that constitutes the second portion is the number of the cylinder in question within said group.

Figure 5:
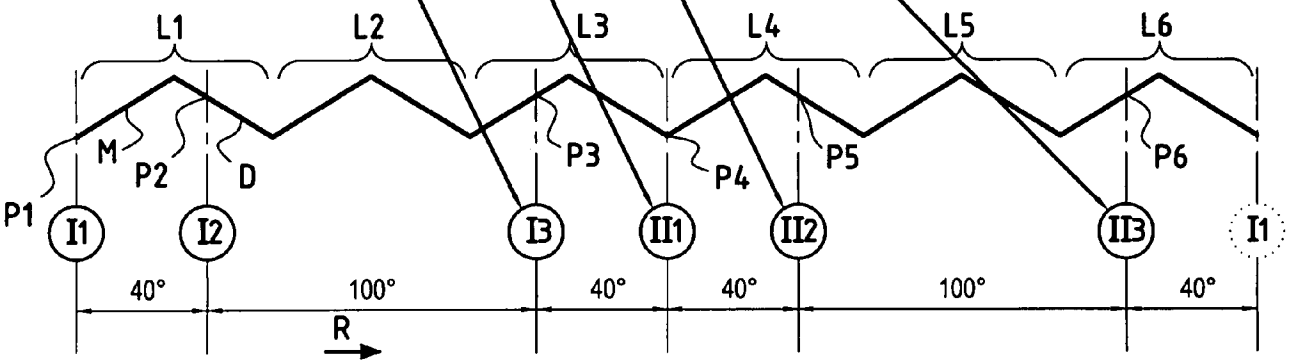
FIG. 5 is a view analogous to FIG. 4 for a motor of the invention having six cam lobes and six pistons, and for which two cam lobes are unused in any relative angular position of the cylinder block and of the cam.
Figure 6:
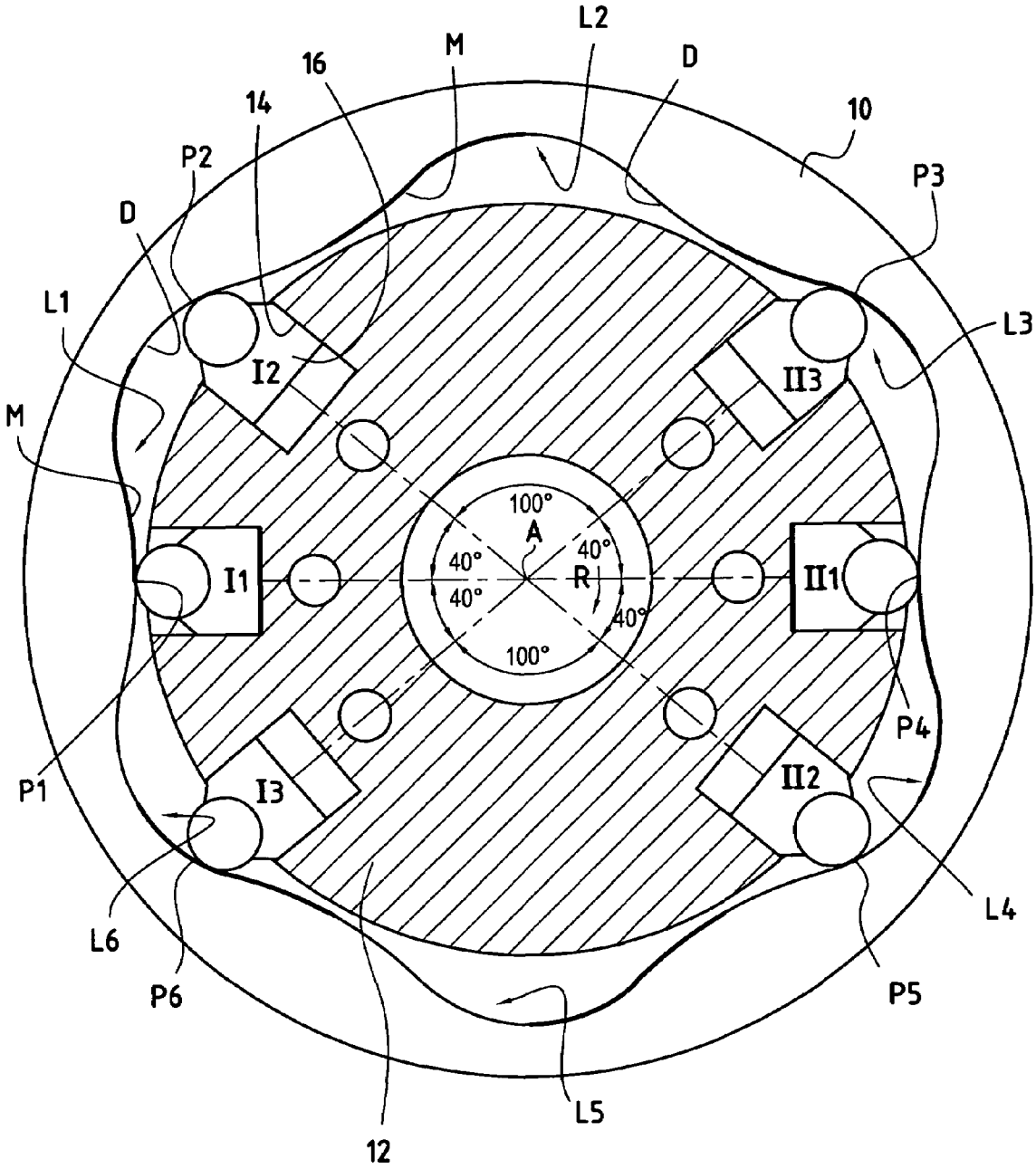
FIG. 6 is a diagrammatic radial section view for the motor having six cam lobes and six pistons corresponding to FIG. 5.

FIG. 6 is a view analogous to FIG. 2 but for a motor of the invention. In FIG. 6, it can be seen that, at any time during the relative rotation of the cylinder block and of the cam, i.e. for any relative position of those two elements, two cam lobes are unused because no piston is in contact with them at that instant. In this example, in the position shown in FIG. 6, the cam lobes L2 and L5 are instantaneously unused. This can also be seen in the developed view of the cam of this motor, as shown in FIG. 5.

The motor of FIG. 6 can be derived from the motor of FIG. 2, by modifying the cylinder block so as to omit certain cylinders and thereby reduce the cubic capacity of the motor, and by distributing the cylinders suitably to ensure that the motor is a constant-velocity motor, and to ensure that the resultant of the forces exerted by the pistons on the cam is small. More precisely, in the motor of FIGS. 2 and 3, the spacing E0 between the cylinders is constant and is equal to 360°/Npo, where Npo is the number of cylinders of the motor, and is equal to 9, so that Eo is equal to 40°.

Figure 4:
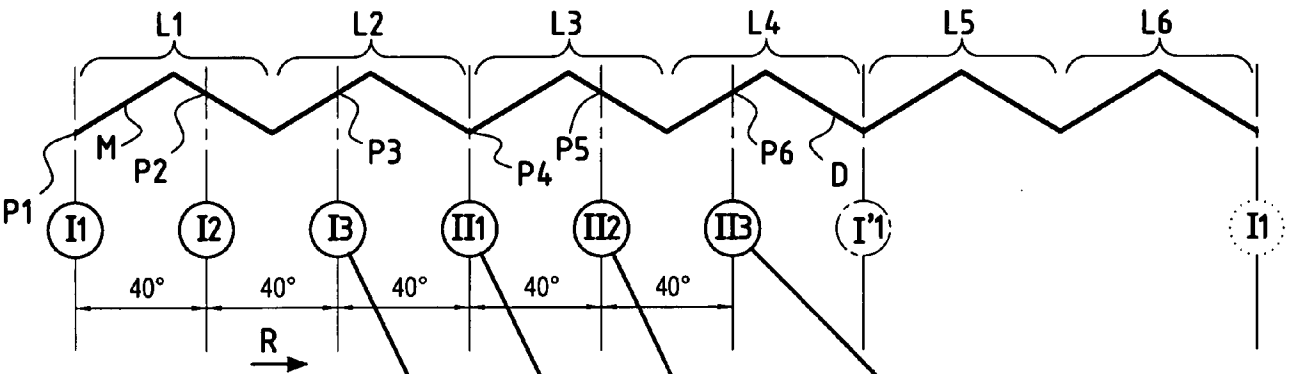
FIG. 4 is a view analogous to FIG. 3, for an imaginary intermediate motor having six cam lobes and six pistons, and which is constant-velocity over four cam lobes.

FIG. 4 is a developed view showing the cam of an imaginary intermediate motor that is useful for determining the construction of the motor of the invention, in the variant shown in FIGS. 5 and 6. In this example, said imaginary intermediate motor is built from the pre-existing motor, which is shown as developed in FIG. 3.

This imaginary intermediate motor has the same cam as the original motor, with its six cam lobes numbered from L1 to L6.

When the cylinder block and the cam are in the relative position shown in FIG. 4 (referred to as the "reference relative position" below), it is the two lobes L5 and L6 that are unused. Compared with the original motor shown in FIG. 3, all three cylinders III1, III2, and III3 of the third group, which were facing these cam lobes, have been omitted. The cylinders I1 to II3 remain, and they are spaced apart from one another by Eo=40°, and, in the position shown in FIG. 4, they are grouped together facing the cam lobes L1 to L4.

The imaginary intermediate motor is constant-velocity over four cam lobes and with its six cylinders I1 to II3. This means that, in the reference position of FIG. 4, the uniform angular spacing between the grouped-together cylinders can be such that the cylinder that would naturally follow the last cylinder II3 of the group of grouped-together cylinders while keeping the same spacing relative to said last cylinder would find itself in exactly the same position on the cam as the first cylinder I1 of said group, ignoring the unused lobes L5 and L6. In other words, considering, in the reference position, that only the lobes L1 to L4 are used, and insofar as the first cylinder I1 is on the first vertex of the first cam lobe L1, i.e. at the bottom of its rising ramp M, it is necessary for the cylinder I'1 that would naturally follow the cylinder II3 with the same spacing relative thereto as the spacing Eo that exists between all of the cylinders to find itself on the first vertex of the cam lobe L5, i.e. at the bottom of its rising ramp M. In this example, this naturally applies with the spacing of 40° of the original motor since it can be seen that the cylinder III1 that is omitted in FIG. 3 is indeed situated at this location. This is due to the fact that the motor of FIGS. 2 and 3 is a constant-velocity motor, not only over all nine of its cylinders, but also over each of its groups I, II, III of cylinders, and for each group this applies over two cam lobes.

It can be seen that the first cylinder of each group I1, II1, III3 finds itself facing the first vertex of an odd cam lobe L1, L3, and L5. In addition, the fluid budget of the motor of FIG. 4 is zero for each of the groups I and II because, if it is considered that the cylinder block is rotating in the direction R relative to the cam, the fluid leaving the second cylinder of the group (I2 or II2) is compensated by the fluid entering the third cylinder I3 or II3) and no fluid enters or leaves the first cylinder (I1 or II1).

The imaginary intermediate motor is unbalanced since, in the reference position (in FIG. 4), all six of the cylinders are facing the first four cams L1 to L4.

With reference to FIG. 2, it can be understood that omitting the cylinders III1, III2, III3 would lead to the resultant of the forces exerted by the pistons on the cam having a relatively large value and being substantially oriented in the same direction as the arrow F indicated in FIG. 2.

In the variant shown in FIGS. 5 and 6, the motor of the invention is derived from the imaginary intermediate motor of FIG. 4 by angularly distributing the cylinders differently. In FIG. 4, in the reference position, the six cylinders I1 to I3 are disposed so that their respective pistons co-operate with the cams L1 to L4 used in the respective positions P1 to P6.

In the motor of FIG. 5, in the reference position shown, it is the lobes of the cams L2 and L5 that are instantaneously unused. The six cylinders are distributed in such a manner that the positions P1 to P6 are preserved unchanged on the other cam lobes. Thus, the cylinders I1 and I2 maintain their original position and the positions P1 and P2 on the cam lobe L1 are thus maintained. The cam lobe L2 is unused. The third cylinder I3 of the first group is spaced apart from the cylinder I2 so that, in the reference position, its piston co-operates with the cam lobe L3 in the same position P3 as the position in which it cooperates with the cam lobe L2 in FIG. 4. Similarly, the cylinders of the second group II1 to II3 are moved as indicated by the arrows that extend from FIG. 4 to FIG. 5 so that, in the same reference position, their pistons co-operate with the cam lobes L4 and L6 in the same positions P4, P5, and P6 as the positions in which they co-operate with the lobes L3 and L4 of FIG. 4.

FIG. 6 is a radial section view of the cam of this variant of the motor of the invention, with its cylinder block having six cylinders, the cylinder block and the cam being in the same relative reference position as in FIG. 5. It can be seen that the pistons co-operate with the cam lobes L1, L3, L4, and L6 in the positions P1 to P6.

As indicated in FIGS. 5 and 6, for this motor having 6 cam lobes and 6 cylinders, and for which 2 cam lobes are unused in any relative position of the cylinder block and of the cam, the angular spacings between the consecutive cylinders are respectively substantially equal to 40°, 100°, 40°, 40°, 100°, and 40°. Naturally, the machining constraints for machining the cylinder block and the manufacturing tolerances mean that the angular spacings can be slightly different from the above-mentioned spacings, as expressed by the adverb "substantially". The variations can be about plus or minus 0.5°. It can be seen that the spacing of 100° between the cylinders that are spaced far apart is not a multiple of the spacing of 40° between the other cylinders.

By considering FIG. 6, it can be understood that this motor is substantially balanced, i.e. that the resultant of the forces exerted by the pistons on the cam is substantially zero. Each piston occupying a given position on the cam lobe corresponds to another piston that is diametrically opposite and that occupies an analogous position on another cam lobe. Thus, each of the pistons of the cylinders I1 and II2 that are diametrically opposite each other co-operates with the middle region of the falling ramp of a respective cam lobe; each of the pistons of the cylinders I3 and II3 that are diametrically opposite co-operates with the middle region of a rising ramp M of a respective cam lobe.

The motor of FIGS. 5 and 6 is constant-velocity over the 4 cam lobes that are instantaneously in use in every relative angular position of the cylinder block and of the cam.

A motor with a cylinder block having cylinders analogous to the cylinders of the motor of FIG. 6 and having six cam lobes, none of which is instantaneously unused, would be constant-velocity over all of its six cam lobes if, like the motor of FIG. 2, it had a number Npo of cylinders uniformly distributed at a spacing Eo, where Npo is equal to 9 and Eo is equal to 360°/Npo, i.e. 40°. It should be noted that in the motor of FIGS. 5 and 6, the spacing between consecutive cylinders is never less than said spacing Eo.

As indicated with reference to FIG. 1, the motor of the invention can have a plurality of active operating cubic capacities. In particular, this applies to the motor of FIGS. 5 and 6 which can be constant-velocity both in a large operating cubic capacity and in a small operating cubic capacity.

More precisely, this motor has a number Nc of cam lobes equal to 6, and a number Np of cylinders equal to 6; it is constant-velocity over a number Nco of cam lobes equal to 4, and, as indicated above, the maximum number Npo of cylinders that it could have analogous to its own cylinders and while remaining constant-velocity over its Nc cams would be Npo equal to 9 with the cylinders being uniformly distributed. The numbers Npo and Nc have a common divisor d equal to 3. There exists a number m equal to 2 such that $Nco=4=Nc.m/d=6\times2/3$ and such that $Np=6=Npo.m/d=9\times2/3$. Under these conditions, a group of $Nc/m=6/2=3$ cam lobes can be inactive when the motor is in its small cubic capacity. In this example, these considerations are easy to verify on the motor of FIGS. 5 and 6 in which two of the three groups of cylinders of the original motor of FIG. 3 are retained.

It is recalled that in order to make the cam lobes inactive in the small cubic capacity, it is necessary to make provision for the distribution ducts situated in register with the rising and the falling ramps of said cam lobes not to be alternately connected to the fluid feed and to the fluid discharge. However, in order to avoid premature wear on the bearings supporting the rotary portion of the motor, it is advantageously chosen for the lobes that are inactive in the small cubic capacity to be interposed between two active lobes. In other words, the six cam lobes L1 to L6 of the motor of FIG. 6 are distributed into two groups of three cam lobes, i.e. one-group L1, L3, and L5 and another group L2, L4, and L6, the lobes of the second group being inactive in the small cubic capacity.

Another variant of a motor of the invention is described below with reference to FIGS. 7 to 10.

Figure 7:
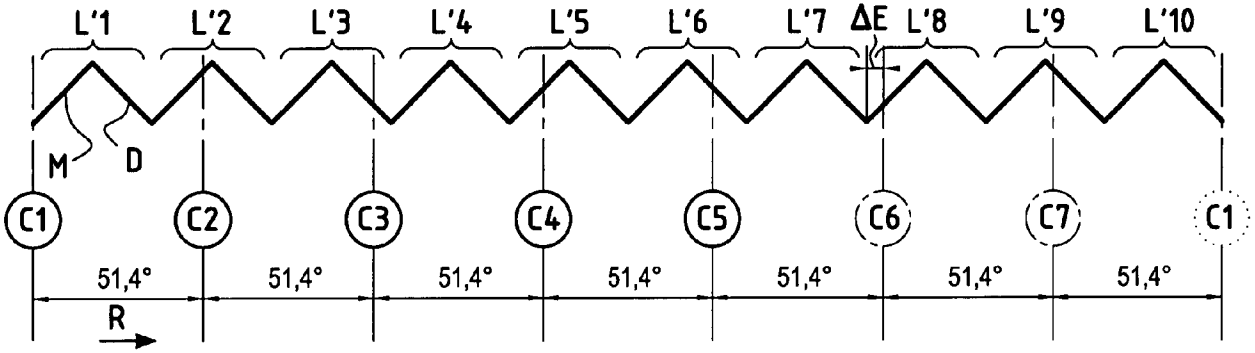
FIG. 7 is a diagrammatic developed view showing the positions of the pistons on the cam lobes for a motor having ten cam lobes and seven pistons, with the cylinder block and the cam in a reference relative position.
Figure 8:
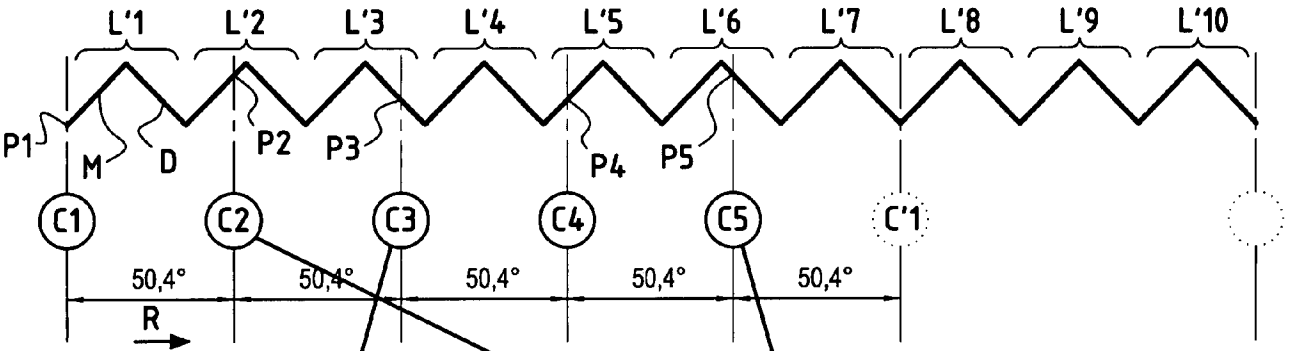
FIG. 8 is a view analogous to FIG. 7 for an imaginary intermediate motor having ten cam lobes and five pistons, and which is constant-velocity over seven cam lobes.
Figure 9:
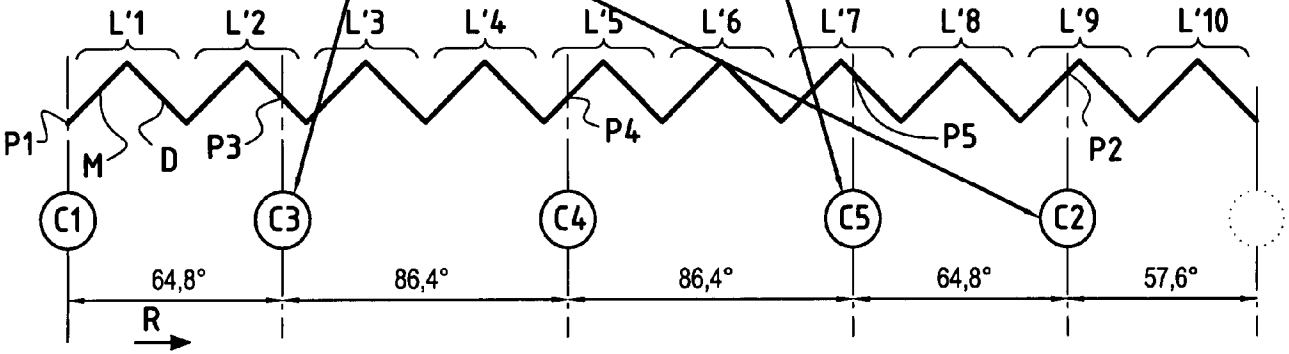
FIG. 9 is a view analogous to the FIG. 8 view for a motor of the invention having ten cam lobes and five pistons.

FIG. 7 is a developed view of the cam and indicates the positions of the cylinders of a conventional motor having ten cam lobes, numbered L'1 to L'10 and seven cylinders, numbered C1 to C7. Thus, for this motor, Nc=10 and Npo=7. In FIGS. 7 to 9, the rising ramps M and the falling ramps D are indicated for a direction of rotation R of the cylinder block relative to the cam.

Figure 10:
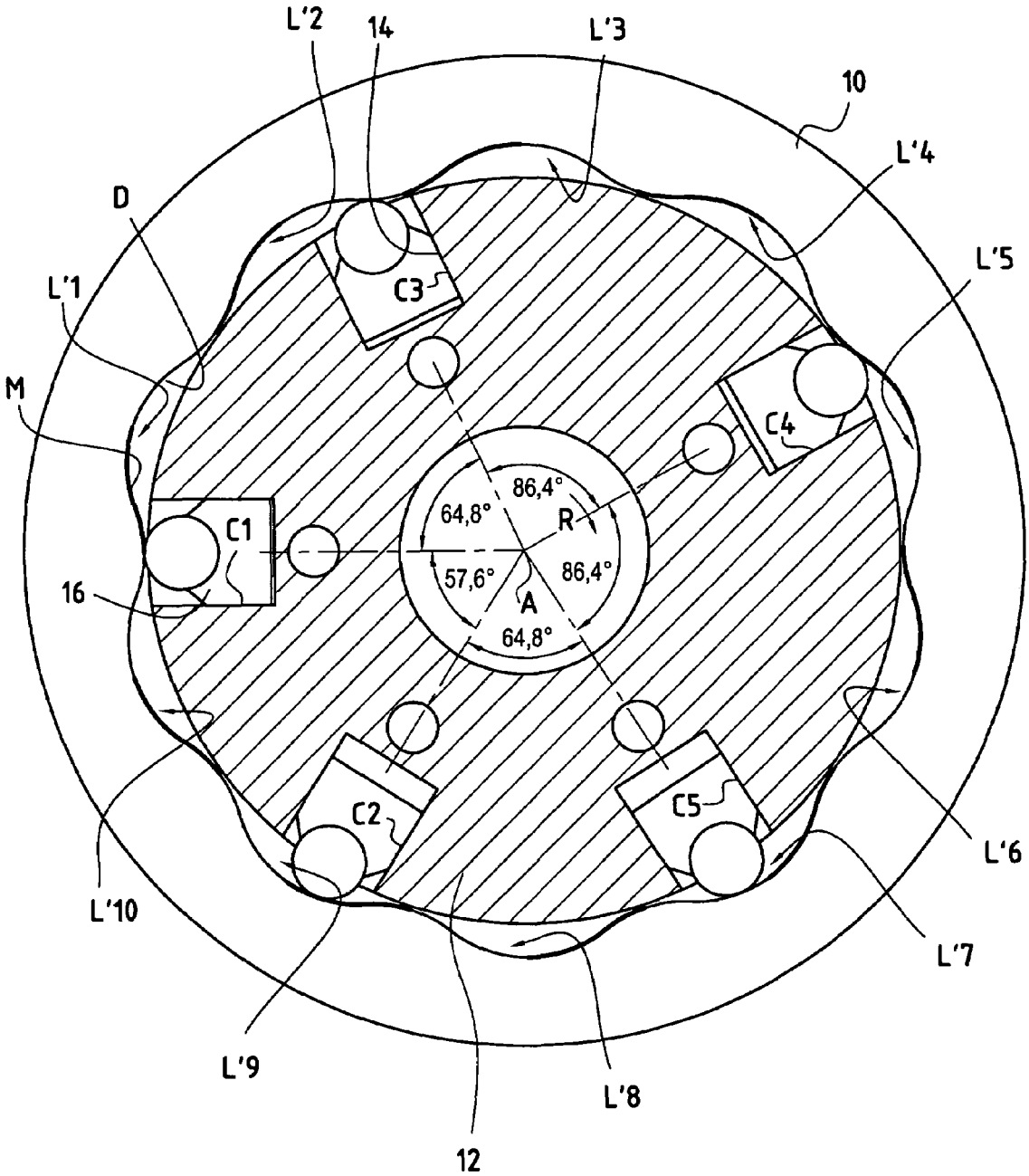
FIG. 10 is a diagrammatic radial section view for a motor having ten cam lobes and five pistons corresponding to FIG. 9.

In the variant of FIGS. 9 and 10, the motor of the invention is constant-velocity over seven of its ten cam lobes.

FIG. 8 is a developed view of the cam, and the positions of the cylinders for the imaginary intermediate motor which is constant-velocity over seven grouped-together cam lobes, so that the number Nco is equal to 7. It can be seen in FIG. 8 that the fluid budget is zero, since the fluid leaving the cylinders C3 and C5 is compensated by the fluid entering the cylinders C2 and C4, respectively, while no fluid enters or leaves the cylinder C1.

In the reference position shown in FIG. 8, the first cylinder C1 is in a position such that its piston co-operates with the first vertex of the first cam lobe L'1, thereby determining the reference position of the cylinder block and of the cam that is chosen for FIGS. 7 to 9. The cylinders are grouped together facing the seven first cam lobes L'1 to L'7. Thus, the cylinders C1 to C5 of the motor of FIG. 7 are retained while the cylinders C6 and C7 are omitted.

In order for the motor of FIG. 8 to be constant-velocity over seven cam lobes, with its cylinders grouped together and spaced apart uniformly, if a cylinder C'1 were added after the cylinder C5, while complying with the same angular spacing between all of the grouped-together cylinders, it would be necessary for the additional cylinder C'1 to be in contact with the first vertex of the cam lobe L'8 in the same position as the cylinder C1 relative to the lobe L'1.

Unlike the situation described with reference to FIGS. 3 to 6, the situation shown in FIGS. 7 to 10 requires the positions of the cylinders to be readjusted between the original motor corresponding to FIG. 7 and the imaginary intermediate motor corresponding to FIG. 8. The first cylinder omitted from the original motor C6 does not face the first vertex of the cam lobe L'8.

In the original motor, the cylinders are uniformly spaced apart, the spacing Eo between consecutive cylinders being equal to 360°/Npo, i.e. about 51.4°, where Npo is equal to 7. In the reference position shown in FIG. 7, the first cylinder C1 is facing the first vertex of the cam lobe L'1 and, due to the spacing Eo, the position of the cylinder C6 is situated facing the cam lobe L'8, while being spaced apart by spacing ΔE relative to the first vertex of said lobe.

In order to define the configuration of the imaginary intermediate motor, it is thus necessary to correct this spacing ΔE. This is achieved by spacing the cylinders C1 to C5 apart uniformly by a spacing value: Ei=(360°.Nco/Nc)/Np, i.e. (360×7/10)/5, i.e. 50.4°.

In this imaginary intermediate motor, and for the reference position shown in FIG. 8, the pistons of the cylinders C1 to C5 occupy respective angular positions P1 to P5 on the cam lobes L'1, L'2, L'3, L'5, and L'6. This motor is constant-velocity over seven cam lobes. However, as explained above with reference to the preceding variant, insofar as all of the cylinders are grouped together, the motor is unbalanced, i.e. the resultant of the forces exerted by the pistons on the cam is too large. Therefore, in order to derive the motor of the FIG. 9 from the imaginary motor of FIG. 8, and considering the reference position of FIGS. 7 and 8, the cylinders are distributed over the various cam lobes in such a manner as to keep the same angular positions on the respective cam lobes that said cylinders used to have, while making provision for the forces exerted by a piston on the cam to be substantially compensated by the forces exerted by one or more substantially opposite pistons. In this example, the cylinder C3 is disposed facing the cam lobe L'2 in the position P3 that it had relative to the lobe L'3, the cylinder C5 is disposed facing the cam lobe L'7 in the position P5 that it had relative to the lobe L'6, and the cylinder C2 is disposed facing the cam lobe L'9 in the position P2 that it had relative to the lobe L'2. The positions of the cylinders C1 and C4 are unchanged.

Thus, as can be seen in FIGS. 9 and 10, the second variant of the motor has ten cam lobes and five cylinders, the angular spacing between the consecutive cylinders being respectively equal to 64.8°, 86.4°, 86.4°, 64.8°, and 57.6°. In practice, in view of manufacturing tolerances, the spacing values can vary by plus or minus 0.5° relative to the values given above. It can be seen that the spacing values different from 57.6° are not multiples thereof. In addition, these spacings are all greater than the minimum spacing Eo which is 51.4° for the motor of FIG. 7.

In order to define the motor of the invention, the starting point is advantageously a pre-existing motor having Npo cylinders, as shown for example by the developed views of FIGS. 3 and 7. After choosing a smaller number of cylinders Np, the number Nco of cam lobes over which the motor must be a constant-velocity motor is then defined, and starting from said number Nco, the angular spacing between the grouped-together cylinders of the intermediate motor is defined, as shown in FIG. 4 or 8, so that the motor is constant-velocity over said Nco cam lobes. Then the Np cylinders of the motor are distributed in the cylinder block so that their angular positions relative to the respective cam lobes are preserved, so as to ensure that the motor is indeed a constant-velocity motor. This distribution is performed so that the resultant of the forces exerted by the pistons on the cam is as small as possible.

In order to define a motor of reduced cubic capacity that has a plurality of possible operating cubic capacities, the starting point is an original constant-velocity motor (e.g. as shown in FIGS. 2 and 3) for which the numbers Npo of cylinders and Nc of cam lobes have an integer common divisor d. An integer number m at least equal to 2 and less then d is then determined that is an integer divisor of the number Nc, and the imaginary intermediate motor is defined in such a manner that the number Nco of cam lobes over which said motor is a constant-velocity motor is equal to Nc.m/d, and that the number Np of its cylinders is equal to Npo.m/d. Finally at least one group of Nc/m cam lobes are defined whose cam lobes can be made inactive so as to cause the hydraulic motor to operate in its small active cubic capacity.

Advantageously, when the motor has at least one small and one large operating cubic capacity, it comprises at least two groups of cam lobes, the cam lobes of one of the groups being inactive in the small cubic capacity. In which case, it is possible to choose to give all of the cam lobes of one of the groups an identical profile that is different from the profile of the cam lobes of the other group.

It is indicated above that the depth of the cam lobes is one of the parameters that determines the cubic capacity of the motor. It is thus possible to determine the depth of the cam lobes that are active in a given operating cubic capacity so that the value of said cubic capacity is precisely equal to a determined value.

What is claimed is:

1. A hydraulic motor comprising a cam and a cylinder block that are suitable for rotating one relative to the other about an axis of rotation, the cam comprising a plurality of cam lobes each of which has a rising ramp and a falling ramp, and the cylinder block having a plurality of cylinders slidably receiving pistons that are suitable for co-operating with the cam, the motor further comprising a fluid distributor that is constrained to rotate with the cam about the axis of rotation and that includes distribution ducts connected via distribution orifices to a feed or to a discharge and suitable for communicating with the cylinders while the cylinder block and the cam are rotating relative to each other, each distribution orifice being disposed in register with a ramp of a cam lobe such that a cylinder whose piston is co-operating with a rising ramp can be connected to the feed and such that a cylinder whose piston is co-operating with a falling ramp can be connected to the discharge, the instantaneous angular positions in which the pistons co-operate with the cam while the cylinder block and the cam are rotating relative to each other being such that the motor is a substantially constant-velocity motor;

wherein, in any relative position of the cylinder block and of the cam, there is at least one cam lobe that is unused and with which no piston co-operates, and wherein the angular spacings between consecutive cylinders are mutually different and differ from a multiple of the smallest angular spacing between consecutive cylinders, said angular spacings being determined so that the resultant of the forces exerted by the pistons on the cam is small or substantially zero.

2. A motor according to claim 1, comprising Np cylinders and Nc cam lobes, the angular spacings between the Np cylinders are determined as follows:

angular positions Pi are defined for an imaginary intermediate motor comprising a cam that has Nc cam lobes and an imaginary intermediate cylinder block having a number Np of cylinders that are grouped together so that the angular spacing Ei between two consecutive grouped-together cylinders is equal to (360°.Nco/Nc)/Np and, when the cylinder block and the cam of said imaginary intermediate motor are in a reference relative position, where the piston of each cylinder occupies an angular position Pi (for i in the range 1 to Np), on a respective one of the Nc cam lobes, and where the number Nco is the number of consecutive cam lobes over which the imaginary intermediate motor is a constant-velocity motor; and the Np cylinders of the hydraulic motor are distributed in the cylinder block in such a manner that, when the cylinder block and the cam are in a relative position corresponding to said reference relative position of the cylinder block and of the cam of the imaginary motor, the piston of each cylinder occupies, on a cam lobe, the same angular position Pi as in the imaginary motor, and in such a manner that the resultant of the forces exerted by the pistons on the cam lobes is smaller than the resultant of the forces in the imaginary motor.

3. A motor according to claim 1, comprising Np cylinders and Nc cam lobes, wherein the angular spacings between consecutive cylinders are not less than an angular spacing Eo equal to 360°/Npo, where Npo is an integer number greater than Np and representing the maximum number of cylinders analogous to the cylinders of said motor that could be distributed uniformly in the cylinder block.

4. A motor according to claim 3, having at least one small and one large active operating cubic capacity, said motor comprising not less than at least one group of Nc/m cam lobes whose cam lobes are inactive when the motor is in its small cubic capacity, where m is an integer divisor of Nc and not less than 2, and is defined as follows:

an imaginary intermediate motor having the cam that has Nc cam lobes and Np cylinders analogous to those of said motor would be constant-velocity over Nco cam lobes;

the numbers Npo and Nc have an integer common divisor d; and the number m is such that Nco is equal to Nc.m/d and Np is equal to Npo.m/d.

5. A motor according to claim 1, comprising Np cylinders and Nc cam lobes, wherein the angular spacings between consecutive cylinders are not less than an angular spacing Eo equal to 360°/Npo, where Npo is an integer number greater than Np and representing the maximum number of cylinders analogous to the cylinders of said motor that could be distributed uniformly in the cylinder block, the motor having at least one small and one large active operating cubic capacity, said motor comprising not less than at least one group of Nc/m cam lobes whose cam lobes are inactive when the motor is in its small cubic capacity, where m is an integer divisor of Nc and not less than 2, and is defined as follows:

an imaginary intermediate motor having the cam that has Nc cam lobes and Np cylinders analogous to those of said motor would be constant-velocity over Nco cam lobes;

the numbers Npo and Nc have an integer common divisor d; and the number m is such that Nco is equal to Nc.m/d and Np is equal to Npo.m/d.

6. A motor according to claim 1, wherein the cam has a number of cam lobes Nc equal to 6, and wherein the cylinder block has 6 cylinders, the angular spacings between the consecutive cylinders being respectively equal to 40°, 100°, 40°, 40°, 100°, and 40°.

7. A motor according to claim 6, wherein the six cam lobes are distributed into two groups of three cam lobes, one lobe of each group being interposed between two lobes of the other group.

8. A motor according to claim 1, wherein the cam has 10 cam lobes, and wherein the cylinder block has 5 cylinders, the angular spacings between the consecutive cylinders respectively being substantially equal to 64.8°, 86.4°, 86.4°, 64.8°, and 57.6°.

9. A method of designing a hydraulic motor according to claim 2, said method consisting in:

defining an imaginary intermediate motor comprising a cam having Nc cam lobes of which a number Nco of cam lobes is chosen so that the imaginary intermediate motor is constant-velocity over Nco cam lobes, an imaginary intermediate cylinder block having a number Np of cylinders grouped together so that the angular spacing Ei between two consecutive grouped-together cylinders is equal to (360°.Nco/Nc)/Np, and defining a reference relative position of the cylinder block and of the cam of said imaginary intermediate motor, in which reference relative position the piston of each cylinder occupies an angular position Pi, on a respective one of the Nc cam lobes; and then defining the cylinder block of the hydraulic motor by distributing the Np cylinders of the imaginary intermediate motor in said cylinder block in such a manner that, when the cylinder block and the cam are in the same relative position as the reference relative position of the cylinder block and of the cam of the intermediate motor, the set of angular positions in which the pistons of the hydraulic motor co-operate with the cam lobes of said motor is identical to the set of angular positions Pi occupied by the pistons on the cam lobes of the imaginary intermediate motor, and in such a manner that the resultant of the forces exerted by the pistons on the cam lobes is less than the resultant of said forces in the imaginary intermediate motor.

10. A method of designing a hydraulic motor according to claim 2, said method consisting in:

starting from an existing design for an original constant-velocity motor comprising a cam having Nc cam lobes, all of the lobes being active, and an original cylinder block having a number Npo greater than Np of cylinders distributed uniformly at an angular spacing Eo equal to 360°/Npo;

defining an intermediate motor comprising the cam having Nc cam lobes of said original motor and of which a number Nco of cam lobes is chosen so that the imaginary intermediate motor is constant-velocity over Nco cam lobes, an imaginary intermediate cylinder block having a number Np of cylinders grouped together so that the angular spacing Ei between two consecutive grouped-together cylinders is equal to (360°.Nco/Nc)/Np, and defining a reference relative position of the cylinder block and of the cam of said imaginary intermediate motor, in which reference relative position the piston of each cylinder occupies an angular position Pi, on a respective one of the Nc cam lobes; and then defining the cylinder block of the hydraulic motor by distributing the Np cylinders of the imaginary intermediate motor in said cylinder block in such a manner that, when the cylinder block and the cam are in the same relative position as the reference relative position of the cylinder block and of the cam of the intermediate motor, the set of angular positions in which the pistons of the hydraulic motor co-operate with the cam lobes of said motor is identical to the set of angular positions Pi occupied by the pistons on the cam lobes of the imaginary intermediate motor, and in such a manner that the resultant of the forces exerted by the pistons on the cam lobes is less than the resultant of said forces in the imaginary intermediate motor.

11. A method according to claim 10, wherein the Np cylinders of the imaginary intermediate motor are distributed in the cylinder block of the hydraulic motor such that the angular spacings between two consecutive cylinders are at least equal to Eo.

12. A method according to claim 10, wherein a constant-velocity original motor is chosen for which the numbers Npo and Nc have an integer common devisor d, an integer number m is determined that is at least equal to 2 and less than d, and that is an integer divisor of the number Nc, the imaginary intermediate motor is defined such that the number Nco is equal to Nc.m/d and such that the number Np is equal to Npo.m/d, and at least one group of Nc/m cam lobes is determined whose cam lobes can be inactivated so as to cause the hydraulic motor to operate in a small active cubic capacity.

13. A method according to claim 10, wherein the Np cylinders of the imaginary intermediate motor are distributed in the cylinder block of the hydraulic motor such that the angular spacings between two consecutive cylinders are at least equal to Eo and wherein a constant-velocity original motor is chosen for which the numbers Npo and Nc have an integer common devisor d, an integer number m is determined that is at least equal to 2 and less than d, and that is an integer divisor of the number Nc, the imaginary intermediate motor is defined such that the number Nco is equal to Nc.m/d and such that the number Np is equal to Npo.m/d, and at least one group of Nc/m cam lobes is determined whose cam lobes can be inactivated so as to cause the hydraulic motor to operate in a small active cubic capacity.

* * * * *